US007623004B2

(12) United States Patent
Wolk et al.

(10) Patent No.: US 7,623,004 B2
(45) Date of Patent: Nov. 24, 2009

(54) METHOD AND STRUCTURE FOR INHIBITING MULTIPACTOR

(76) Inventors: Dieter Wolk, Zu den Obstgaerten 16, 71522 Backnang (DE); Isabel Montero Herrero, C/ Valle de Oro 47, Madrid (ES) 28019; Luis Galan Estella, C/ Camino de Ganapanes 25, Esc. 1, 7 A, Madrid (ES) 28035; David Raboso Garcia-Baquero, Maria Rutgersweg 102, Leiden (NL) 2331-NX ( * ) Notice: Subject to any disclaimer, the term of this patent is extended or adjusted under 35 U.S.C. 154(b) by 138 days.

(21) Appl. No.: 11/521,268

(22) Filed: Sep. 13, 2006

(65) Prior Publication Data

US 2009/0261926 A1 Oct. 22, 2009

(51) Int. Cl.
*H01J 25/76* (2006.01)

(52) U.S. Cl. ..... 333/99 MP

(58) Field of Classification Search ..... 333/99 MP
See application file for complete search history.

(56) References Cited

U.S. PATENT DOCUMENTS

2005/0276743 A1* 12/2005 Lacombe et al. ..... 423/447.3

FOREIGN PATENT DOCUMENTS

JP 08047766 * 8/1994

* cited by examiner

*Primary Examiner*—James H. Cho
*Assistant Examiner*—Thienvu V Tran
(74) *Attorney, Agent, or Firm*—Jordan and Hamburg LLP

(57) ABSTRACT

A method of reducing multipactor effect occurrence on surfaces in a high energy field, e.g., RF devices, is provided and RF devices having a configuration produced by the method are provided. The method includes forming wall structures formed of a metallic wall material and defining a channel through which the RF energy travels, the wall material having a wall material surface. A porous layer is disposed over the wall material surface and has a porous layer upper surface opposite a porous layer lower surface facing the wall material surface. The porous layer defines pores with openings distributed in the porous layer upper surface. A conductive layer is disposed over the porous layer upper surface.

18 Claims, 7 Drawing Sheets

METHOD AND STRUCTURE FOR INHIBITING MULTIPACTOR

BACKGROUND

The present invention provides RF components which have reduced occurrence of multipactor effect in high power RF applications, and in particular, space applications. The present invention further provides a method for reducing Mulitpactor effect in high power RF applications and other high energy environments including applying a surface treatment or coating having a low secondary electron emission yield (SEY), or secondary electron emission coefficient.

The multipactor effect is an electron cloud in a vacuum that grows in avalanche in resonance with a high frequency electromagnetic field. The electron avalanche is accelerated by the field and is fed back by secondary electron emission produced by electrons impacting on exposed surfaces. This electron discharge limits the achievable power in RF devices working in a vacuum. Multipactor is a serious problem in fields of great technological importance such as high power RF hardware in space, high-energy particle accelerators, and klystrons and other high-power RF vacuum tubes. The multipactor resonance conditions can often be avoided by proper design of parameters pertaining the electromagnetic field; however, there remain always critical parts where multipactor can only be avoided by low secondary emission surfaces.

In the secondary electron emission process one electron impacting on a surface can transfer part of its energy to one or more electrons of the surface that are thus emitted back into vacuum. A secondary emission yield of more than one electron per impacting electron is needed for multipactor effect to be possible. The secondary emission yield directly influences in the risk of multipactor discharge.

A coating used to reduce the multipactor effect should have low electrical resistivity to avoid deterioration of the RF performance of the device. The requirements of low secondary emission and low surface resistance are, for physicochemical reasons, in contradiction with surface stability in air, this last requirement being of most importance for space applications. The best generally known coating material found to date is titanium nitride (TiN) which dominates in other applications (different from space), such as in vacuum devices. Deterioration of TiN surface properties because of long exposure to air is recovered by special treatments (surface conditioning by vacuum heat treatments or ion/electron bombardment) once the surface is under vacuum for operation.

TiN surface conditioning treatments are impossible or impractical in space applications. As a consequence, the best generally known coating found for these applications is Alodine for aluminium alloys; it is a chromate conversion coating for corrosion protection and as such it is very stable in air. However, its electrical conductivity is not sufficient for the ever increasing RF-performance requirements. A further drawback is the use of chemicals with the dangerous $Cr^{VI}$ ion in the preparation of chromate conversion coatings like Alodine.

SUMMARY OF THE INVENTION

It is an object of the present invention to provide a method for reducing occurrence of multipactor effect.

It is a further object of the present invention to provide a layered structure which inhibits occurrence of multipactor effect.

It is a still further object of the present invention to provide RF components having a layered structure which inhibits occurrence of multipactor effect.

Briefly stated the present invention provides a method of reducing multipactor effect. In particular, the invention reduces multipactor effect in RF devices or in relation to surfaces in an environment otherwise producing multipactor effect. Furthermore, the present invention provides RF devices having a configuration produced by the method. The method includes forming wall structures formed of a metallic wall material and defining a channel through which the RF energy travels, the metallic wall material having a wall material surface. A porous layer is disposed over the wall material surface and has a porous layer upper surface opposite a porous layer lower surface facing the wall material surface. The porous layer defines pores with openings distributed in the porous layer upper surface. A conductive layer is disposed over the porous layer upper surface.

In an embodiment of the present invention, devices of magnesium alloy are treated with a coating to form the above stated configuration. Objects and results of the present invention include improvements over devices formed of aluminum having an Alodine treatment in four main properties: i) multipactor breakdown performance, ii) RF performance, iii) mechanical/weight properties, and iv) avoidance of use of dangerous chemicals.

The present invention also has as an object improvement upon TiN coatings in multipactor breakdown performance for applications where in-vacuum surface conditioning techniques can be used.

The present invention includes an embodiment wherein the porous layer is disposed on the wall material surface and the conductive layer is disposed on the porous layer upper surface.

The present invention additionally provides an embodiment wherein the porous layer has a porous layer thickness of about 3 to 25 μm, and the conductive layer has a thickness of about 1 to 15 μm.

A further feature of the present invention which is optionally utilized is the wall material being formed at least in part by magnesium or aluminum. The wall material is preferably an alloy of aluminum or magnesium.

Another feature of the present invention includes the porous layer being a ceramic oxide. The porous layer has a thickness in a range of about 3 to 25 μm.

Another feature of the present invention is the pores having an average diameter of about 2 to 3 μm, and the pores defining surface openings with a total opening area in a range of about 15 to 40% of a planar surface area of the porous layer. A preferred embodiment includes the surface openings occupying about 27% of the planar surface area of the porous layer.

A further feature of the present invention includes the porous layer being formed by a patented process known commercially as ANOMAG.

Yet another feature includes the conductive layer being either silver or gold.

The above, and other objects, features and advantages of the present invention will become apparent from the following description read in conjunction with the accompanying drawings, in which like reference numerals designate the same elements. The present invention is considered to include all functional combinations of the above described features and is not limited to the particular structural embodiments shown in the figures as examples. The scope and spirit of the present invention is considered to include modifications as may be made by those skilled in the art, having the benefit of the present disclosure, which substitute, for elements presented in the claims, devices, structures or materials upon which the claim language reads or which are equivalent thereto, and which produce substantially the same results associated with those corresponding examples identified in this disclosure for purposes of the operation of this invention. Additionally, the scope and spirit of the present invention is intended to be defined by the scope of the claim language itself and equivalents thereto without incorporation of structural or functional limitations discussed in the specification which are not referred to in the claim language itself.

DETAILED DESCRIPTION OF THE INVENTION

Figure 1:
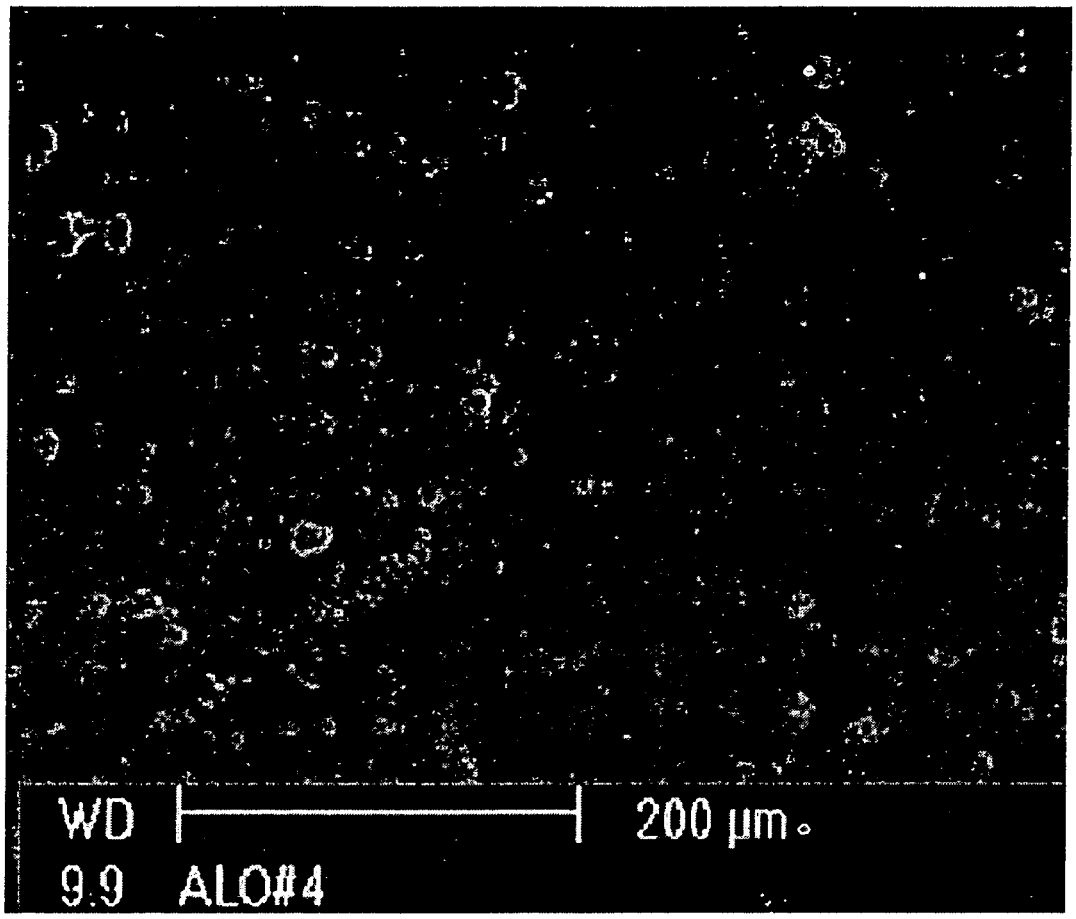
FIG. 1 is an SEM micrograph of Alodine on aluminum alloy.

The present invention provides surface structures and devices wherein secondary emission of electrons is suppressed and thereby multipactor effect is reduced in RF devices and other high energy applications, and the present invention also provides a method for reducing secondary emission of electrons and thereby reducing the multipactor effect. In particular the present invention provides a porous metal coating for suppressing secondary electron emission, or secondary emission yield (SEY) and the multipactor effect. In a preferred embodiment the coating has an inert or noble-metal with a deeply structured surface, with microscopic pinholes or pores.

Various surface treatments have been investigated with regard to reducing SEY. Surface treatments, or coatings, are characterized herein by: a) preparation procedure, b) surface morphology, c) secondary emission coefficient, d) multipactor breakdown level, and e) RF performance (insertion loss) in special test devices. Characterizations for TiN are for space applications, e.g., TiN coatings tested without any surface conditioning in vacuum. Coatings investigated include Alodine which is a coating used on aluminum alloy for space applications and is discussed in the following materials: A. Woode and J. Petit, Diagnostic investigations into the multipactor effect, susceptibility zone measurements and parameters affecting a discharge, ESTEC Working Paper No. 1556, ESTEC ESA (1989); EuropeanCooperation for Space Standardization, Space engineering, Multipaction design and tests, ECSS-E-20-01A, 5 May 2003; Philip S. G. Scott, An investigation of Alodine surface finish on three aluminium alloy, ESTEC Working Paper No. 1435, ESTEC ESA (1985). Further investigated were TiN coatings (no special substrate required) for applications in vacuum devices which is discussed in the following: M. Pivi, R. E. Kirby, T. O. Raubenheimer, and F. Le Pimpec, Suppressing electron cloud in future linear colliders, SLAC-PUB-11201, May 2005; F. Le Pimpec, F. King, R. E. Kirby, and M. Pivi, Secondary electron yield measurements from thin surface coatings for NLC electron cloud reduction. Proceedings of EPAC 2004, Lucerne, Switzerland; P. He, H. C. Hseuh, R. Todd, B. Henrist, N. Hilleret, F. Le Pimpec, R. E. Kirby, M. Pivi, and S. Kato, M. Nishiwaki, Secondary electron emission measurements for TiN coating on the stainless steel of SNS accumulator ring vacuum chamber, Proceedings of EPAC 2004, Lucerne, Switzerland; F. Le Pimpec, F. King, R. E. Kirby, and M. Pivi, Secondary Electron Yield Measurements of TiN Coating and TiZrV Getter Film, Linear Collider Collaboration Tech Notes, LCC-0128, SLAC-TN-03-052, October 2003, Rev. August 2004; and J. Lorkiewicz, A. Brinkmann, and M. Layalan, Surface TiN coating of TESLA couplers at DESSY, TESLA Report, DESSY, 2002-2.

The surface morphology of these coatings and the present invention was examined by SEM (Scanning Electron Microscopy) at SIDI of the Universidad Autónoma de Madrid, Spain. The secondary electron emission coefficient (ratio of number of emitted electrons to number of impacting or primary ones) for normal incidence as a function of primary energy in the energy range of interest for the multipactor effect, was measured at Applied Physics Department of Universidad Autónoma de Madrid, Spain. A. Woode and J. Petit, Ibid.

Alodine is a chromate conversion coating used to protect aluminum alloys from corrosion in the atmosphere. Philip S. G. Scott, Ibid.; P. L. Hagans, C. M. Haas, Chromate conversion coatings, in: C. M. Cotell, J. A. Sprague, F. A. Scrido Jr. (Eds.), ASM Handbook, Surface Engineering, Vol. 5, ASM International, 1994, p. 405; F. W. Lytle, R. B. Gregor, G. L. Bibbins, K. Y. Blohowiak, R. E. Smith, G. D. Tuss, Corrosion Sci. 37 (1995) 349-369; and P. M. Wikoff, D. F. Suciu, Conversion Coatings: A Literature Review, Environmental Research and Development, Inc., Idaho Falls, Id. 1993. It is prepared by chemical treatments, by immersion of the aluminum sample in baths, including $[CrO_4]^{2-}$ in solution, and a final desiccation treatment. In the chemicals, one finds the dangerous $Cr^{-VI}$ ion that is on the EPA list as a carcinogen. http://www.epa.gov/iris/subst/0144.htm. This ion is supposed to remain in the finished Alodine coating and partly explains corrosion protection properties of the Alodine. The procedure is commercial and patented. The Alodine coating, whose properties are shown here, was prepared by Tesat Spacecom on aluminum alloy.

This procedure results in a thin coating, about 0.5 μm thick, of complex chemical nature, containing O, C, N, F, Cr, Al, Fe, Zr, and Cu, mostly in form of oxides. This thin coating is electrically conductive. Its resistivity can be estimated by its influence on RF insertion losses compared to those of silver. See Table II below. Its surface morphology is shown in the SEM micrographs of FIG. 1. The secondary emission coefficient is shown in FIG. 2, along with those of other coatings for comparison.

The results of testing Alodine coating for multipactor breakdown level and RF performance are presented below along with those of other coatings for comparison.

Titanium Nitride has a stochiometric formula of TiN. For the present application it is prepared in thin coatings of 5 to 200 nm thickness. It is usually prepared by two main techniques a) reactive sputtering (generally, magnetron) from a Ti target in a $N^{2+}$ Ar low-pressure atmosphere, and b) reactive evaporation (specifically, sublimation) from a Ti or Ti—Mo alloy filament in a $N_2$ or $NH_3$ low-pressure atmosphere.

When a TiN coating is prepared pure and stochiometric in ultra-high vacuum, its properties, secondary emission and electrical conductivity, are excellent and relatively stable in air. However, usual commercial apparatus are at most in the high-vacuum category and partial oxidation is inevitable, thus, those properties and their stability in air are deteriorated. Once the device is under vacuum, and prior to operation, the TiN coating is typically subjected to a surface conditioning treatment comprising high temperature annealing (300-600° C.) or bombardment with low-energy electrons or ions, scrubbing.

The deposition technique of reactive evaporation, in its simplicity, is easier to control and to improve to ultra-high vacuum category in the laboratory, and thus produces the best TiN coatings. They can be deposited over most substrate materials, aluminum, silver, gold, stainless steel.

The TiN coating whose properties are shown herein was prepared by reactive evaporation from a Ti—Mo filament in $N_2$ low-pressure atmosphere in an ultra-high vacuum equipment by the Instituto de Ciencia de Materiales de Madrid, CSIC, Spain. The coating was 40 nm thick, and deposited over a Ag-plated aluminum test sample. The Ag plating was 10 μm thick Ag over 10 μm thick Nickel, electrolytically deposited. The test sample was supplied by Tesat Spacecom.

Figure 3:
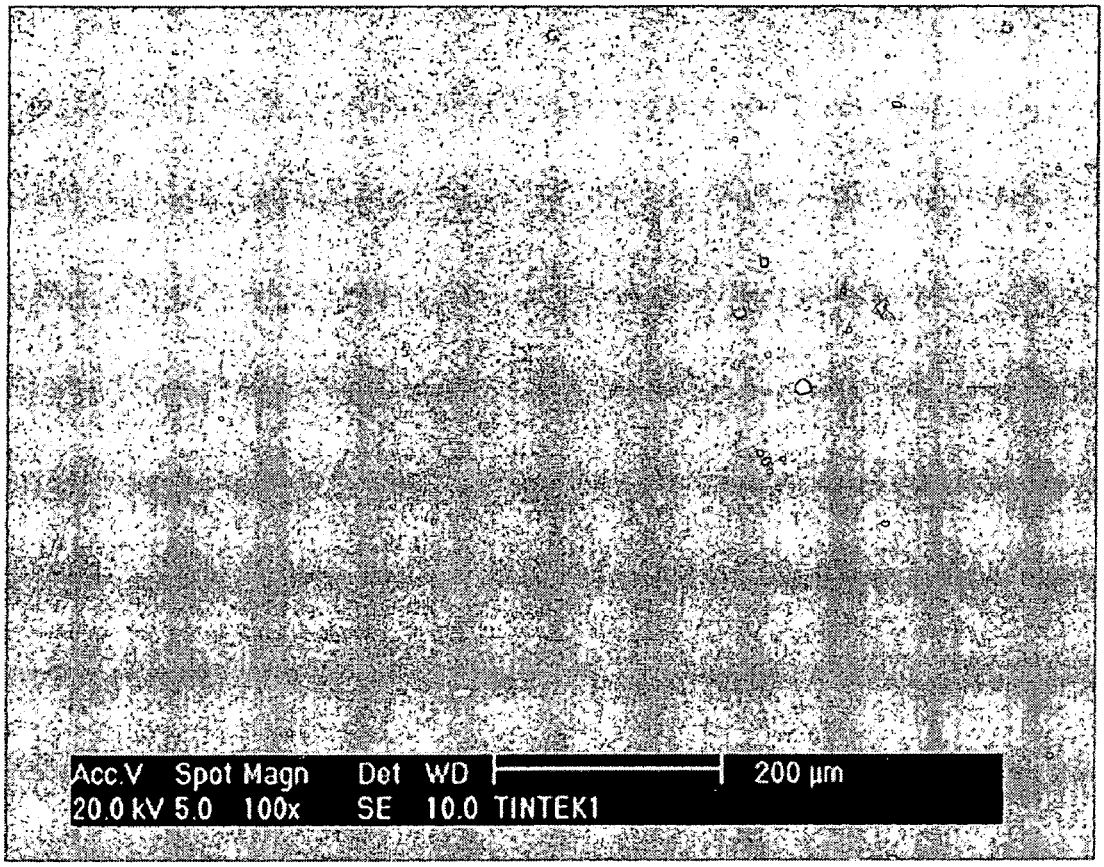
FIG. 3. SEM is a micrograph of TiN on Ag-plated aluminum alloy.

The surface morphology of the 40 nm thick TiN coating is shown in FIG. 3 and corresponds to that of a substrate material underneath the TiN coating which is in the test sample Ag-plated milled aluminum alloy.

Figure 6:
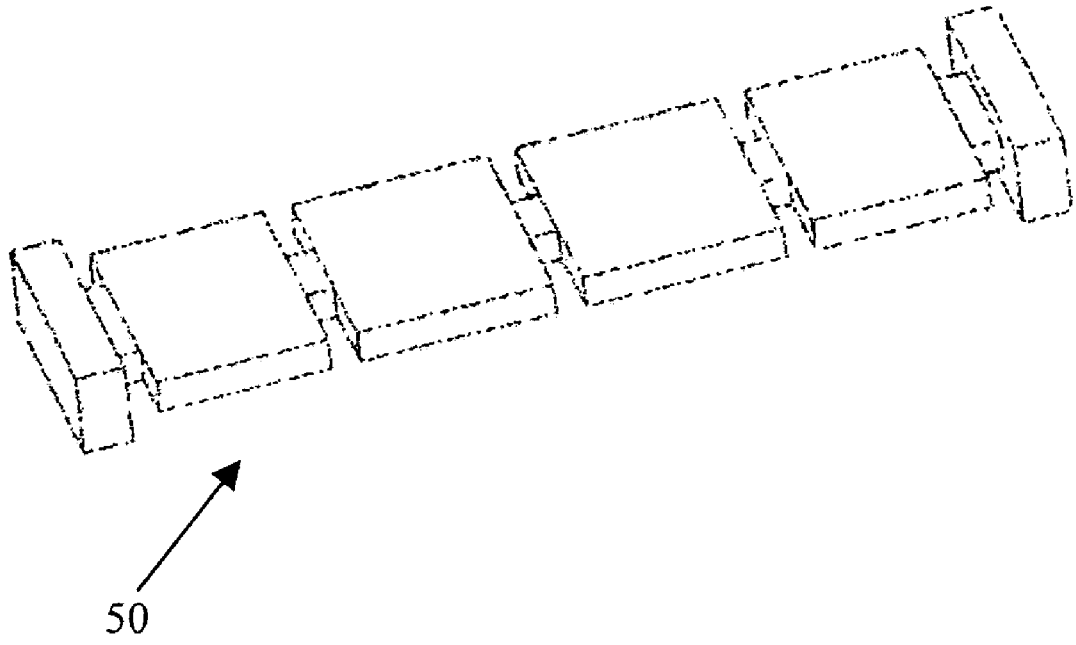
FIG. 6 is a perspective view of a typical waveguide component which has walls coated in accordance with the present invention

In an advantageous embodiment of the present invention a coating, or layered structure, of the invention is used in high-power RF (radio-frequency) hardware. Referring to FIG. 6 a typical component employing the present invention is shown as a waveguide bandpass filter 50 with inductive diaphragms, as used frequently in output branches of Ku band multiplexers of high RF power in communications satellites.

The present invention is also considered to include a method for reducing the multipactor effect which includes employing the layered structured described herein in RF components. Such hardware, may be used for space applications and in particle accelerators. The present invention includes an embodiment based in magnesium alloys which is but one example of a material to which the generalized invention may be applied.

A working principle of the method and the coating embodiment of this invention is that emitted secondary electrons are largely absorbed by walls having pores formed in a coating applied to a substrate material, such as magnesium as used in the embodiment disclosed herein. The present invention reduces SEY and multipactor effect because: a) a large portion of a surface area of the coating is in the pores of the coating; b) a large part of the emitted secondary electrons are from a pore impact on walls of the pore, c) a large fraction of the emitted secondary electrons have very low energies, less than 50 eV (this is a general property for any material), and d) the secondary emission coefficient of the walls for those energies is less than one, i.e., they are absorbing for those energies. Thus, the coating is suppressing an important part of the secondary emission by a surface morphology effect.

The present invention preferably employs materials having a low secondary emission for low primary energies. This directs one to noble metals like Ag and Au. These metals also satisfy the requirement of low surface resistance and stability in air. However, it is to be understood that the present invention, unless so specified in particular claims, is not considered to limited to noble materials. Furthermore, the coating of the present invention may be embodied, for example, as including ceramic like materials, an aluminum oxide, or a magnesium oxide, or ceramic materials non-exclusively including an aluminum oxide or a magnesium oxide which forms a porous structure.

Figure 4:
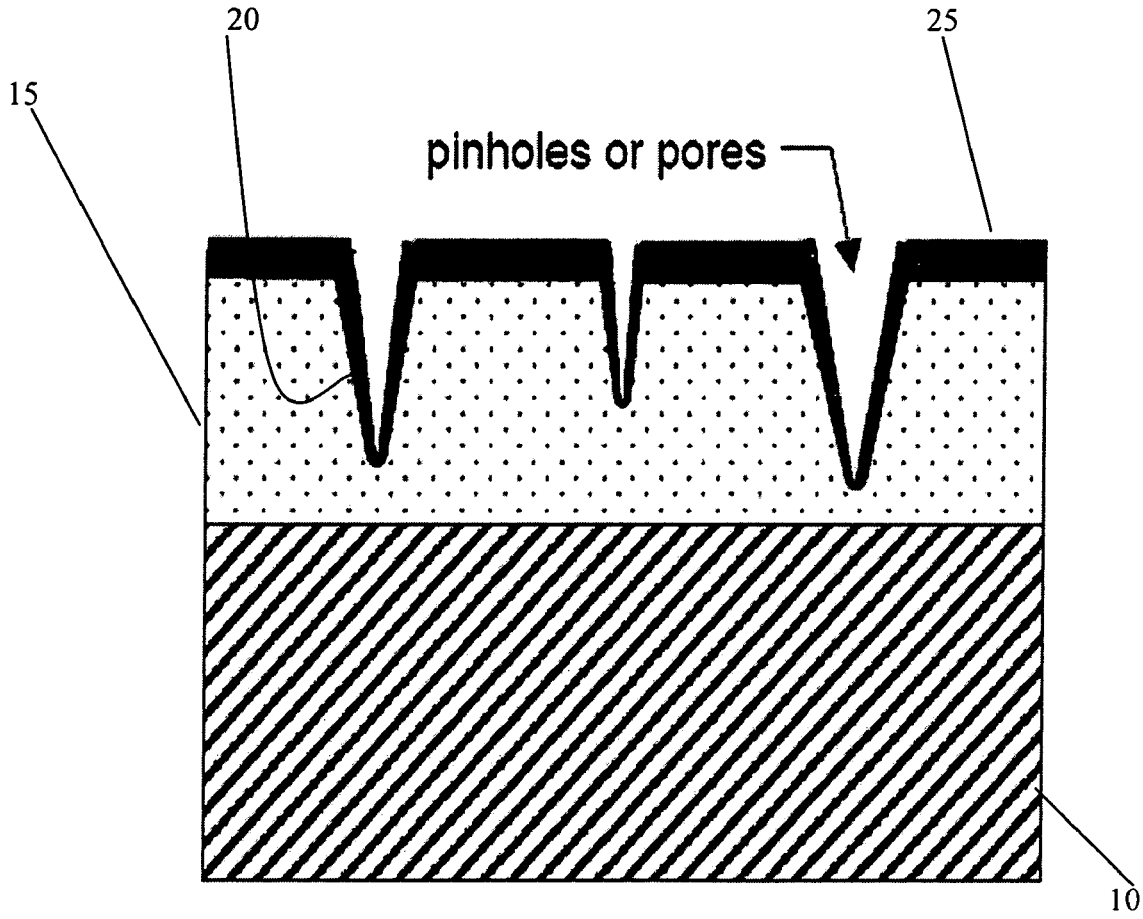
FIG. 4. is a crossectional-drawing of a portion of a wall of a waveguide device showing a schematic depth structure or profile of a layer structure of a coating of the present invention coating wherein the coating is constituted by a noble metal over layer plus an Anomag coating having pinholes or pores.

Referring to FIG. 4, an embodiment of the present invention is a waveguide device formed of a substrate 10 of which a portion is shown in an enlarged cross-section of a portion of the wavelength device. The present invention is considered to encompass RF devices in general which guide and/or act on RF signals, of which a waveguide device is but one embodiment. The substrate 10 is a conductive material, and in the preferred embodiment described herein is a magnesium alloy used for RF components. Magnesium, aluminum or alloys thereof maybe used as substrate materials of the present invention.

The substrate 10 is treated to provide a porous layer 15, or coating, thereon which in turn defines pores 20. The porous layer 15 is preferably embodied as a as an oxide or ceramic oxide layer in a range of about 3 to 25 μm thickness. An upper limit of the thickness is limited by mechanical stability and adhesion of the porous layer 15 to the substrate 10.

A preferred embodiment of the present invention is realized using a magnesium alloy as the substrate 10 and an intermediate ANOMAG coating, as the porous layer 15. ANOMAG is a trademark name of Magnesium Technology Limited, 137 Captain Springs Road Onehunga, Auckland, New Zealand, for a commercial protective coating for magnesium alloys, deposited by a patented electrochemical procedure. The following materials are hereby incorporated by reference for their teachings related to applying ANOMAG coatings and composition of the ANOMAG coatings: J. E. Gray, and B. Luan, Protective coatings on magnesium and its alloys—a critical review, J. Alloys and Compounds, vol. 336, pp. 88.113, 2002; and T. F. Barton, Anodization of magnesium and magnesium based alloys, U.S. Pat. No. 5,792,335 (1998). The present invention also includes the use of other procedures for porous ceramic oxide coatings for magnesium alloys, such as MAGOXID, described in AHC Oberflachentechnik, Technical Bulletin, Magoxid-Coat/Kepla-Coat (2001), and H. von Campe, D. Liedtke, B. Schum, Method and device for forming a layer by plasma-chemical process, U.S. Pat. No. 4,915,978 (1990), that can optionally be used instead of ANOMAG and which disclosures thereof are hereby incorporated by reference for their teachings of forming coatings and compositions of coatings which are to be used in the practice of the present invention.

The ANOMAG coating used in the embodiment is a ceramic material including Mg oxide, preferably of about 3-8 μm thickness, with a very rough surface which is formed with many microscopic pinholes or pores as the pores 20. However, it is understood the present invention is not restricted to this thickness range nor specific material but is intended to encompass materials providing a porous layer having a porosity in accordance with the porosity described herein. Such materials preferably have an SEY approximately equivalent to that of the material of the Anomag coating, the MAGOXID costing, a KERONITE coating, or coatings of Magnesium oxide or aluminum oxide.

The pores 20 have diameters that range from about 0.2 to 5 μm with the average diameter of the pores 20 being about 2 to 3 μm In the embodiment tested, the coating thickness was about 6 μm. A depth of the pores 20 ranges from about 3 to 5 μm, and is preferably a depth range from about 4 to 5 μm. An area of the pores 20 may be in a range of about 15 to 40% of a planar surface area of the coating. Preferably, the pores 20 occupy about 25 to 35% percent of the planar surface area. In the embodiment yielding the test results provided herein the pores 20 occupied about 27% of the planar surface area. The pores 20 are distributed randomly. In the example embodiment the pores 20 were distributed with an average center to center distance of about 5 μm, however this distance is merely a preferred distance of the test embodiment and may vary between about 2 μm and 100 μm.

On the porous layer 15, an over layer 25 is provided which has high conductivity. This over layer 25 may be applied by any of various known depositing techniques known to those skilled in the art. The porous layer 15 of the instant embodiment is preferably coated, or deposited, with a thin layer of a noble metal which forms the overlayer 25 and conforms to the pores 20. The overlayer 25 is selected to preferably provide high conductivity and thereby reduce insertion loss of the waveguide device.

The thickness of the over layer 25 is determined by an electromagnetic skin depth of the material of the over layer 25 over the frequency range of the waveguide device. This thickness of the metal over layer 25 should take in account the metal resistivity along with the skin depth of the RF wave in the coating metal in order to obtain a certain low value of the surface resistance for good RF performance. Preferably, the thickness of the overlayer 25 is about 5 to 10 times the electromagnetic skin depth at the frequency of operation. The present invention is considered to be applicable at RF frequencies ranging from the UHF range, e.g., about 300 MHz, up through microwave and millimeter wave frequencies such as up to 40 GHz or above.

Figure 5A:
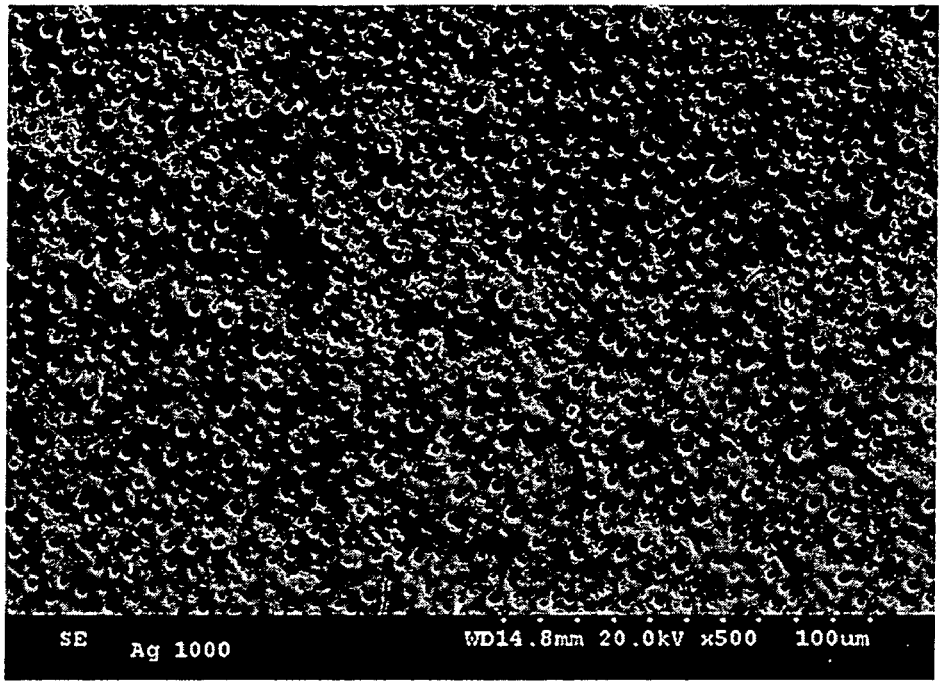
FIGS. 5*a* and 5*b* are SEM micrographs of an Anomag coating with a noble metal over layer of 2 μm Au.
Figure 5B:
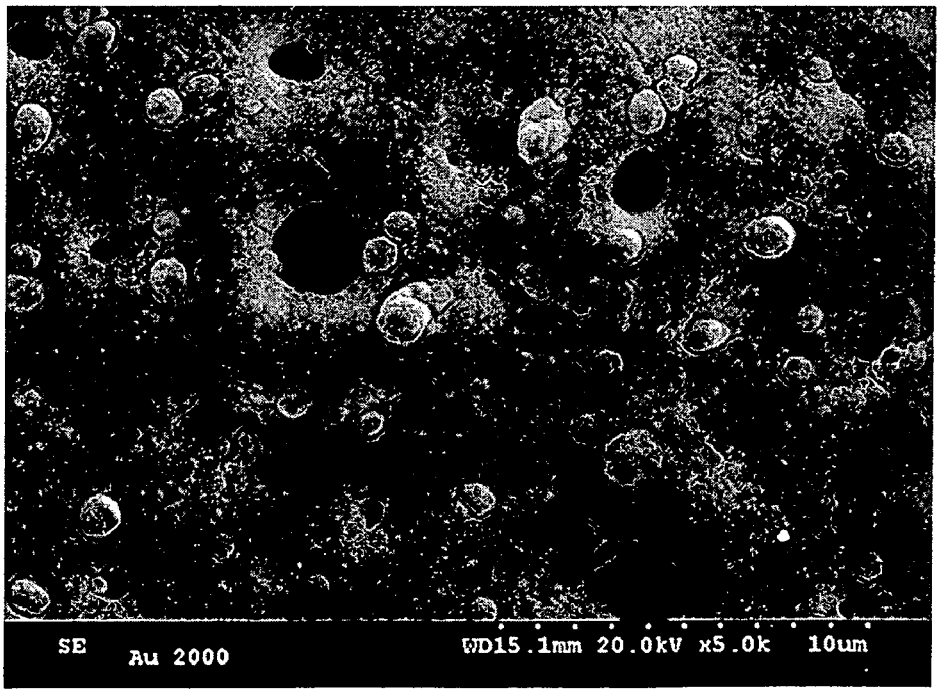
Figure 5C:
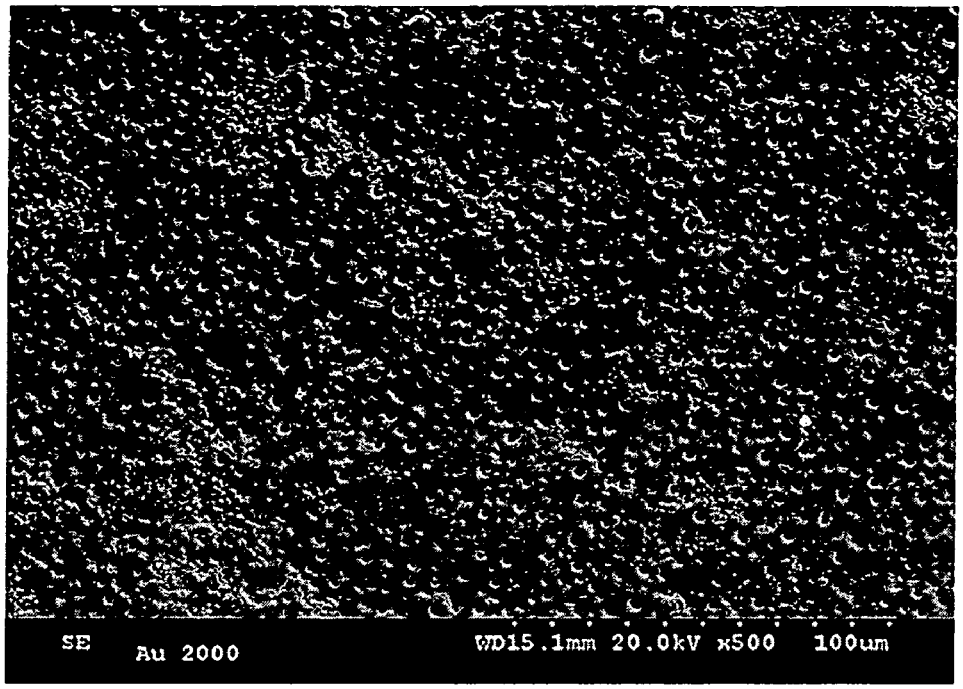
FIGS. 5*c* and 5*d* are SEM micrographs of an Anomag coating with a noble metal over layer of 1 μg.
Figure 5D:
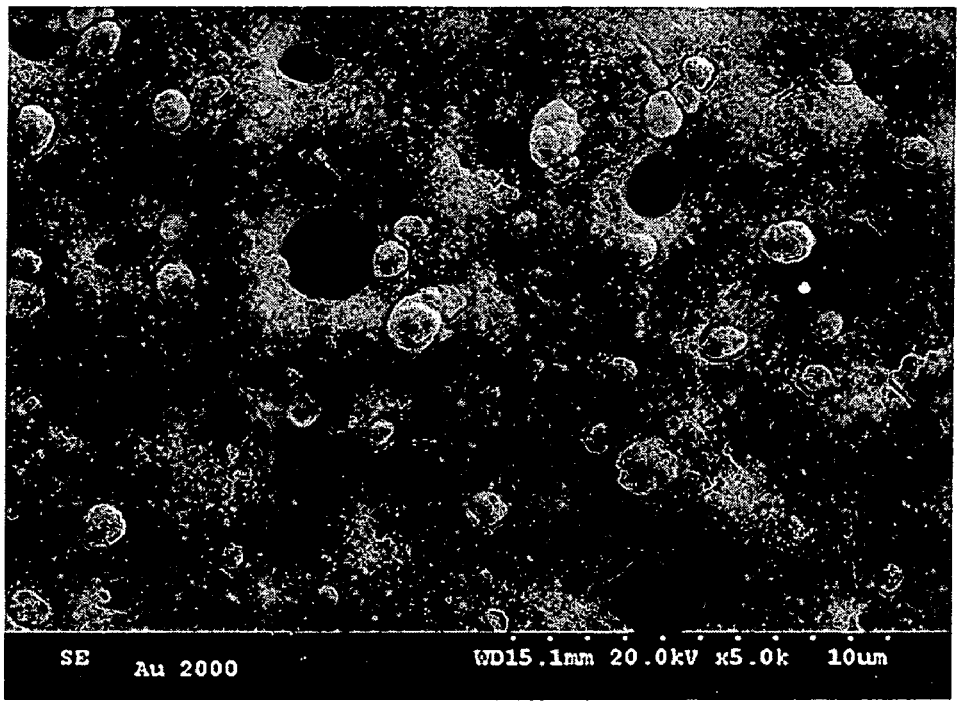

The metal over layer thickness ranges from about 1 to 15 μm. In the embodiments of the tests presented in Table I, the over layer thickness was about 1 μm for 9.5 GHz in Ag and about 2 μm for Au. Thus, the layered structure of the embodiment tested has a depth structure or profile shown schematically in FIG. 4. The relative depths of the porous layer 15, the over layer 25 and the pores 20 are shown approximately to scale. This approximate representation is not considered to be limiting. The appearance of an embodiment coating using ANOMAG as the porous coating 15 and Au of 2 μm thickness as the over layer 25 is shown in microscopy photos of FIGS. 5*a* and 5*b* while an appearance of an embodiment coating using ANOMAG as the porous coating 10 and Ag of a 1 μm thickness as the over layer 25 is shown in microscopy photos of FIGS. 5*c* and 5*d*. The invention further includes use of candidate inert metals as the coating 10, such as Rh and Ir. However, conductivity characteristics of these materials, even with 3 μm thick over layer, does not achieve a surface resistance as low as Ag or Au.

Various known techniques may be employed to provide the over layer 25 and the invention is not limited to any particular technique unless so recited in the claims. It is realized that techniques may be developed in the future for applying material of the over layer 25 and the claims are intended to cover such methods employing such techniques used to apply thin layers of conductive materials. Among techniques known to those skilled in the art, sputtering may be used to apply the over layer 25 from a target of the same metal. Alternatively, for Ag and Au, evaporation from a crucible with the metal, heated by an electron beam (e-gun evaporator) may optionally be employed. Both types of deposition systems are commercially available from different companies and are optionally usable to practice the present invention.

The preferred substrate material of the invention is magnesium alloys because these materials improve exceedingly on aluminum alloys in mechanical properties to weight relation without any lessening in RF performance, as can be observed in Table II below.

Embodiments of the present invention coatings were realized, in both versions of Ag and Au as the metal over layer 25, by applying the coating to specially designed and built test samples.

The basic material of the test samples was magnesium alloy MgAl3ZnF25. The test samples had a milled surface corresponding to that typical of RF waveguides.

The ANOMAG coating was deposited on the test samples by an anodizing procedure, by Fa. Franz-Galvanotechnik, Geretsried; trademark: ANOMAG. The test samples with Anomag coating were supplied by Tesat Spacecom. In the application process voltages of 100 to 300 V are produced in an electrolyte. In so doing, there is an exchange of charges through a natural barrier layer of the magnesium and diffusion of magnesium ions to a reaction zone. Punctiform heat sources are formed on the anodically charge magnesium portion. Because of energy released, there are plasma chemical processes in the form of gas discharges at the surface, as a result of which the latter is oxidized. Other coatings formed based upon anodic plasma chemical oxidation may optionally be used to form the porous layer 15. Other such coatings include those known by trade names MAGOXIDE, and KERONITE.

The Ag and Au metal over layers were deposited by Materials Science Institute of Madrid, CSIC, Spain, by DC (direct current) magnetron sputtering from pure metal targets using a system PLS 500, Pfeiffer, Angstrom Sciences, ONYX 2. The Ag over layer was 1 μm thick. The Au over layer was 2 μm thick, and prior to its deposition a Cr layer of 6 nm thickness was deposited for better adherence.

For description and characterization, surface analysis was carried out as with prior art: a) surface morphology by SEM (Scanning Electron Microscopy), and b) secondary electron emission coefficient, Applied Physics Department, Universidad Autonoma de Madrid. Performance tests, multipactor and RF performance, were also carried out; their description and results are presented below. SEM micrographs are shown in FIGS. 5*a*-5*d*.

Figure 2A:
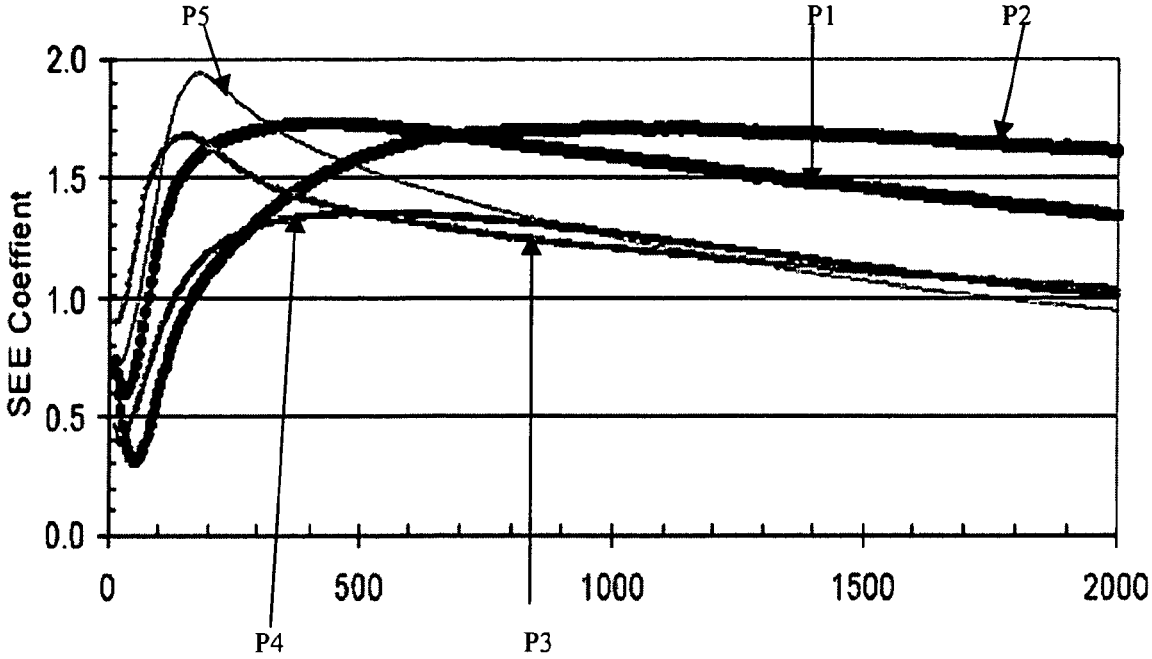
FIG. 2*a* is a plot of secondary electron emission coefficients of the coatings of the present invention and the other coatings over a primary electron energy level range of 0 to 2000 eV.
Figure 2B:
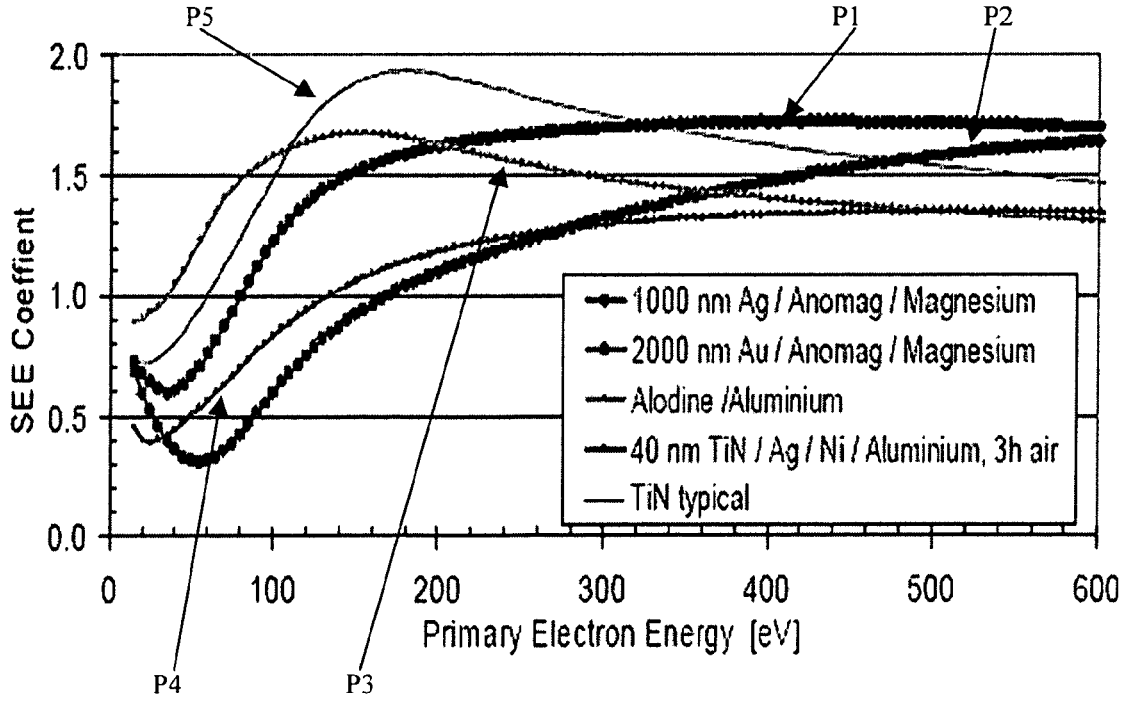
FIG. 2*b* is a plot of secondary electron emission coefficients of the coatings of the present invention and the other coatings over a primary electron energy level range of 0 to 600 eV.

The secondary emission coefficient of the test embodiments of the present invention are shown in FIGS. 2*a* and 2*b*, along with those of other coatings for comparison. The present invention is considered to include definitions as may be shown in the form of ranges or points identifiable from plots P1 and P2 in FIGS. 2*a* and 2*b*, and in particular ranges of SEE alone or in combination with corresponding primary electron energy ranges supported by selection of coordinates in FIGS. 2*a* and 2*b*. The other coatings include TiN and Alodine coatings listed in association with their corresponding plot lines in Table I below.

TABLE I

| PLOT LINE DESCRIPTION | |
|---|---|
| P1 | 1000 nm Ag/Anomag/Magnesium |
| P2 | 2000 nm Au/Anomag/Magnesium |
| P3 | Alodine/Aluminium |
| P4 | 40 nm TiN/Ag/Ni/Aluminium, 3 h air |
| P5 | TiN typical |

The secondary electron emission coefficients of coatings of the present invention and other coatings were measured for normal incidence, after long term air exposure (=3 day), except for TiN, as indicated in Table I. The first four curves correspond to test samples of Table II. The TiN coating listed as typical is representative of usual TiN coatings in vacuum RF devices, after long term air exposure and before vacuum and conditioning.

The results of testing the test embodiment coatings of the present invention and prior art TiN and Alodine coatings for multipactor breakdown level and RF performance are shown in Table II. The test embodiment coatings are two prototypes of the invention which have been realized by applying the invention coating, in both versions of Ag and Au as metal over layer, respectively, to two specially designed and built waveguide test samples of Mg alloy.

TABLE II

Results of Testing the X-Band Waveguides with the Coatings

| Test Sample | Basic material | Coating Layers | Multipactor Breakdown Level [W] | RF Performance Insertion Loss [dB] |
|---|---|---|---|---|
| Invention | Magnesium alloy | Ag/ANOMAG | 3000 | 0.15 |
| Invention | Magnesium alloy | Au/Cr/ ANOMAG | 2850 | 0.14 |
| Prior Art | Aluminum alloy | Alodine | 500 | 0.22 |
| Prior Art | Aluminum alloy | TiN/Ag/Ni | 900 | 0.07 |

For comparison with prior art, two waveguide test samples of equal shape and size were coated with Alodine and TiN over Ag plating, respectively. The multipactor breakdown level and the RF performance (insertion loss) were determined by Tesat Spacecom, Germany.

Because of the field and purpose of the invention, the relevant tests to be carried out are of multipactor breakdown level and RF performance (insertion loss) when applied to appropriate RF devices. The RF devices were X-band waveguide filters (WR 90) containing a corrugated structure: two elements with reduced height (gap, 0.4 mm) and constant width matched with one transformer step on each side. These test samples and the multipactor breakdown level and RF performance tests were designed and performed by Tesat Spacecom, Germany. The multipactor breakdown level was determined for 9.5 GHz using three detection techniques: 3rd harmonic, input reflection nulling, and gain nulling. The value reported in Table II is a mean between a first indication value and a clear indication value. The RF insertion loss was measured by an automatic vector network analyzer. The results of these tests are also shown in Table II.

The TiN coatings, and all other coatings, were tested without any surface conditioning in vacuum and after long term exposure to air, more than 15 days.

This data was obtained within the scope of an ESA study. In this study, a series of waveguide test samples with different geometries and coatings was prepared and measured. The measurement was carried out at a so-called multipaction measuring set-up, consisting of a power amplifier, a ring resonator for power multiplication as well as suitable means for measuring the frequency and power and for indicating the multipaction effect. The test samples and ring resonator were in a thermo vacuum chamber.

Table II shows the superior performance of the invention coatings. In the goal property, multipactor breakdown level, there is an improvement of +7.7 dB over Alodine, the ESA reference coating in space applications; and this occurs with better RF performance. Table II shows also an improvement of +5.1 dB in multipactor breakdown level over TiN, the best coating for vacuum RF devices.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. Such modifications include substitution of materials for materials specifically identified herein, wherein the substitute material provide functional results which permit the overall functional operation of the present invention to be maintained. Such substitutions are intended to encompass presently known materials and processes and those yet to be developed which are accepted as replacements for those identified herein and which produce results compatible with operation of the present invention.

What is claimed is:

1. An RF device for guiding RF energy, comprising:

wall structures formed of a metallic wall material and defining a channel through which said RF energy travels, said metallic wall material having a wall material surface;

a porous layer disposed over said wall material surface and having a porous layer upper surface opposite a porous layer lower surface facing said wall material surface, said porous layer defining pores with openings distributed in said porous layer upper surface, said porous layer being disposed on said wall material surface;

a conductive layer disposed over said porous layer upper surface, said conductive layer being disposed on said porous layer upper surface in a thickness so as to be conductive at RF frequencies; and said pores having pore walls and said conductive layer being disposed on said pore walls so as to conforming to at least portions of the said pore walls, without filling said openings at said porous layer upper surface so as to leave voids; and also be contiguous with portions of said conductive layer on said porous layer upper surface.

2. The RF device of claim 1 wherein:

said porous layer has a porous layer thickness of about 3 to 25 μm; and said conductive layer has a thickness of about 1 to 15 μm.

3. The RF device of claim 2 wherein:

said wall material includes magnesium; and said porous layer is a ceramic oxide.

4. The RF device of claim 3 wherein:

said porous layer has a thickness in a range of about 3 to 8 μm;

said pores have an average diameter of about 2 to 3 μm; and said pores 20 define surface openings occupying an area in a range of about 15 to 40% of a planar surface area of said porous layer.

5. The RF device of claim 4 wherein said surface openings occupy about 27% of said planar surface area of said porous layer.

6. The RF device of claim 2 wherein:

said wall material includes aluminum; and said porous layer is a ceramic oxide.

7. The RF device of claim 2 wherein:

said porous layer has a thickness in a range of about 3 to 8 μm;

said pores have an average diameter of about 2 to 3 μm; and said pores 20 define surface openings occupying an area in a range of about 15 to 40% of a planar surface area of said porous layer.

8. The RF device of claim 7 wherein said surface openings occupy about 27% of said planar surface area of said porous layer.

9. A method for reducing multipactor effect in an RF device for guiding RF energy, comprising:

forming wall structures of a metallic wall material which define a channel through which said RF energy travels, said metallic wall material having a wall material surface;

forming a porous layer disposed over said wall material surface and having a porous layer upper surface opposite a porous layer lower surface facing said wall material surface, said porous layer defining pores with openings distributed in said porous layer upper surface, and porous layer being disposed on said wall material surface;

forming a conductive layer disposed over said porous layer upper surface, said conductive layer being disposed on said porous layer upper surface in a thickness so as to be conductive at RF frequencies; and said pores having pore walls and said conductive layer being disposed on said pore walls so as to be conforming to at least portions of the said pore walls, without filling said opening at said porous layer upper surface so as to leave voids; and also be contiguous with portions of said conductive layer on said porous layer user surface.

10. The method of claim 9 wherein:

said porous layer has a porous layer thickness of about 3 to 25 μm; and said conductive layer has a thickness of about 1 to 15 μm.

11. The method of claim 10 wherein:

said wall material includes magnesium; and said porous layer is a ceramic oxide.

12. The method of claim 10 wherein:

said wall material includes aluminum; and said porous layer is a ceramic oxide.

13. The method of claim 12 wherein:

said porous layer has a thickness in a range of about 3 to 8 μm;

said pores have an average diameter of about 2 to 3 μm; and said pores define surface openings occupying an area in a range of about 15 to 40% of a planar surface area of said porous layer.

14. The method of claim 13 wherein said surface openings occupy about 27% of said planar surface area of said porous layer.

15. The method of claim 14 wherein said conductive layer is one of gold or silver and has a thickness of about 1 to 3 μm.

16. The method of claim 9 wherein:

said porous layer has a thickness in a range of about 3 to 8 μm;

said pores have an average diameter of about 2 to 3 μm; and said pores define surface openings occupying an area in a range of about 15 to 40% of a planar surface area of said porous layer.

17. The method of claim 16 wherein said surface openings occupy about 27% of said planar surface area of said porous layer.

18. The method of claim 17 wherein said conductive layer is one of gold or silver and has a thickness of about 1 to 3 μm.

* * * * *